US007922561B2

(12) United States Patent
Hermann

(10) Patent No.: US 7,922,561 B2
(45) Date of Patent: Apr. 12, 2011

(54) SYSTEM FOR PROVIDING QUANTITATIVE PROCESS CONTROL OF FINESSE POLISHING

(75) Inventor: Justin L. Hermann, Ortonville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 530 days.

(21) Appl. No.: 12/018,223

(22) Filed: Jan. 23, 2008

(65) Prior Publication Data

US 2009/0186556 A1 Jul. 23, 2009

(51) Int. Cl.
*B24B 49/00* (2006.01)

(52) U.S. Cl. ..... 451/5; 451/8

(58) Field of Classification Search ..... 451/5, 8, 451/41

See application file for complete search history.

(56) References Cited

U.S. PATENT DOCUMENTS

| | | | | |
|---|---|---|---|---|
| 3,383,961 | A * | 5/1968 | Dahl | 81/469 |
| 5,594,306 | A * | 1/1997 | Caporusso et al. | 318/245 |
| 7,318,768 | B2 * | 1/2008 | Deshpande et al. | 451/5 |
| 7,476,144 | B2 * | 1/2009 | Dineen et al. | 451/8 |
| 7,485,026 | B2 * | 2/2009 | King | 451/8 |
| 7,534,165 | B2 * | 5/2009 | Milbourne et al. | 451/259 |
| 7,722,435 | B2 * | 5/2010 | King | 451/5 |
| 2005/0065662 | A1 * | 3/2005 | Reindle et al. | 701/1 |
| 2005/0220445 | A1 * | 10/2005 | Baskar et al. | 388/811 |
| 2005/0245182 | A1 * | 11/2005 | Deshpande et al. | 451/357 |
| 2006/0106482 | A1 * | 5/2006 | Etter et al. | 700/180 |
| 2008/0064305 | A1 * | 3/2008 | Cooper et al. | 451/58 |
| 2009/0183888 | A1 * | 7/2009 | Forster et al. | 173/20 |

FOREIGN PATENT DOCUMENTS

| | | | |
|---|---|---|---|
| CN | 1449082 | A | 10/2003 |
| CN | 1905995 | A | 1/2007 |

OTHER PUBLICATIONS

Product sheet for Model 57126 Dynabuffer of Dynabrade, Inc. of Clarence, NY 14031.2 pages. First date believed at least as early as 2006.

Letter dated Jun. 10, 2010 reporting Chinese Office Action, dated May 19, 2010 on Chinese patent application 200910006103.8, which is related to U.S. Appl. No. 12/018,233.

* cited by examiner

*Primary Examiner* — Maurina Rachuba

(57) ABSTRACT

A system for providing quantitative process control of a finesse polishing based upon feedback to the operator as to whether he/she is meeting the one or more predetermined key control characteristics (KCCs). One or more sensors provide data to a controller, wherein the controller provides the operator feedback regarding his/her operational compliance with respect to the KCCs, and disables operation in the event of operator noncompliance, with the intention to promote proper operator procedure and prevent operator error when polishing a flawed painted surface.

7 Claims, 5 Drawing Sheets

SYSTEM FOR PROVIDING QUANTITATIVE PROCESS CONTROL OF FINESSE POLISHING

TECHNICAL FIELD

The present invention relates to devices and methods for polishing painted surfaces, and more particularly to a system that provides quantitative process control of the polishing.

BACKGROUND OF THE INVENTION

In a paint shop, process control is critical in order to insure quality standards are met. This control poses varying levels of difficulty depending on the operation being performed. One particularly challenging operation is finesse sanding and polishing performed by personnel on a painted product, typically using pneumatic hand tools, for the purpose of removal or concealment of small, yet otherwise visible defects. Generally, this operation involves first finesse sanding followed by finesse polishing of the flawed painted surface to achieve a flawless painted surface.

FIG. 1 depicts a prior art finesse polishing operation, in which a polishing tool 10 (for nonlimiting example a model 57126 Dynabuffer™ of Dynabrade, Inc. of Clarence, N.Y. 14031) is held in the hand 12 of an operator at the handle 14 of the polishing tool. When the operator presses down on an actuation arm 18 pivotally mounted on the handle 14, an internally disposed operator actuation device (i.e., an electrical switch or pneumatic valve) actuates the polishing tool, otherwise the polishing tool is not actuated. The polishing tool 10 further includes a head 20 attached to the handle 14, and a rotary component 22 at which a selected polishing pad 24 is located. As seen at FIG. 1, the polishing tool 10 is being used to polish a painted surface 26 so as to thereby impart thereto a flawless finish.

In order to obtain a desired flawless paint finish with each polishing procedure, proper finesse polishing technique must be consistently used by the operator. If the proper finesse polishing technique is not used, then small scratches will remain in the surface of the paint, which can present a dull, swirl-like defect that, although difficult to see under shop lighting, might be perfectly visible in day light. Typically, paint shop management relies on personnel training to insure operators are polishing with proper finesse technique. Unfortunately, training is time consuming and often yields inconsistent long term results.

In identifying criteria involved with a proper finesse polishing technique, there are four key control characteristics (KCCs) involved: polishing time, applied force, tool (pad) rotational speed, and polishing tool movement. With regard to polishing time, this is typically between 8 and 16 seconds, depending on the substrate temperature of the paint surface being polished, wherein as the substrate temperature increases, polishing time should also increase. With regard to applied force, too much force will flatten the waffle structure of the polishing pad and result in swirl marks in the paint, whereas too little force will not adequately remove sanding marks and also result in swirl marks, wherein a target net applied force is, for example, between about one and two pounds (by net applied force is meant total applied force of the polishing pad on the paint surface less the weight of the polishing tool, and wherein the polishing tool 10 of FIG. 1 has a typical weight of about 1.1 pounds). Next, with regard to tool (pad) rotational speed, a relationship exists (discussed in detail hereinbelow) between the tool rotation speed and the force applied by the operator to the painted surface at the polishing pad, wherein higher applied forces result in lower tool rotational speeds. Finally, the polishing pad should move across the flaw continuously to ensure full removal of sanding marks, ideally using a series of mutually orthogonal movements (i.e., x-y axes movements), wherein the pattern uses an overlap of about one-quarter of the polishing pad during each movement.

Accordingly, what would be useful in the art is if somehow a system could be provided which prevents an operator from polishing a flawed painted surface unless predetermined KCCs are met.

SUMMARY OF THE INVENTION

The present invention is a system for providing quantitative process control of finesse polishing based upon automatic polishing tool stoppage in the event of fault detection and continuous operator feedback as to whether the operator is meeting at least one predetermined key control characteristic (KCC), which informational feedback is intended to promote proper operator procedure and prevent operator error when polishing a flawed painted surface.

The system for providing quantitative process control of finesse polishing according to the present invention includes at least one sensor for sensing, and thereby providing data regarding, at least one operational characteristic of the selected polishing tool, a controller (i.e., a microcontroller having appropriate electronic components for data processing and I/O interfacing) which is programmed to recognize the sensed data from the at least one sensor and provide at least one output responsive to the data and the programming, and a feedback indicator providing information regarding operator compliance with the at least one operational characteristic, most preferably at least one predetermined KCC, responsive to the output. The controller monitors operation of the polishing tool and will disable operation of the polishing tool in the event it detects a fault, wherein by "fault" is meant a detected operation of the polishing tool outside an acceptable range of the at least one operational characteristic. The disabling of operation preferably requires a manual reset to re-enable the polishing tool, as for example by manually pressing a reset button.

In operation, the data and the programming enable the controller to provide the operator continually updated feedback, via the indicator, as to his/her compliance with one of more selected KCC during a polishing process. For example, a sensor may sense the rotational speed of the polishing tool and, thereby, the data therefrom allows the controller to recognize the operator applied force of the polishing pad on a painted surface (applied force KCC) over a predetermined polishing time duration (polishing time KCC). Accordingly, the operator is enabled to continually assess his/her compliance with the at least one KCC, via the indicator such as for example predetermined visual and/or audible indications, and thereby make real time corrections, if needed, to maintain KCC compliance, as for example adjusting the applied force to the polishing tool. If the controller determines that the operator is not complying with the at least one predetermined KCC, then the controller will output a fault, whereupon the polishing tool becomes disabled and a manual reset would be required to re-enable operation of the polishing tool.

Preferably, a log is recorded of the polishing tool operational characteristics during polishing cycles which may be accessed for periodic assessment of operator performance.

Accordingly, it is an object of the present invention to provide a system that enables quantitative process control of finesse polishing based upon feedback to the operator of the operator's meeting of predetermined KCCs so as to promote proper operator procedure and prevent operator error when polishing a flawed painted surface.

This and additional objects, features and advantages of the present invention will become clearer from the following specification of a preferred embodiment.

DESCRIPTION OF THE PREFERRED EMBODIMENT

Figure 2:
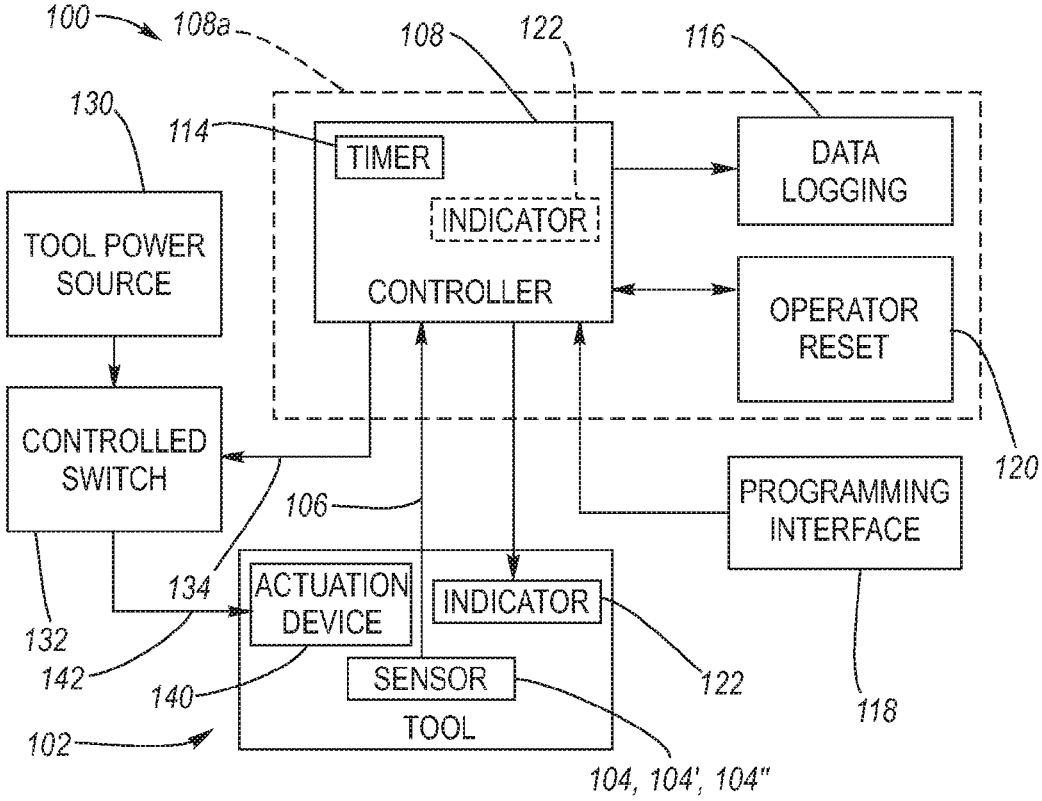
FIG. 2 is a block diagram of an example of apparatus and the interfacing thereof to provide the system according to the present invention.

Turning attention now to FIGS. 2 though 9, FIG. 2 depicts a block diagram overview of the system for providing quantitative process control of finesse polishing 100.

Figure 3:
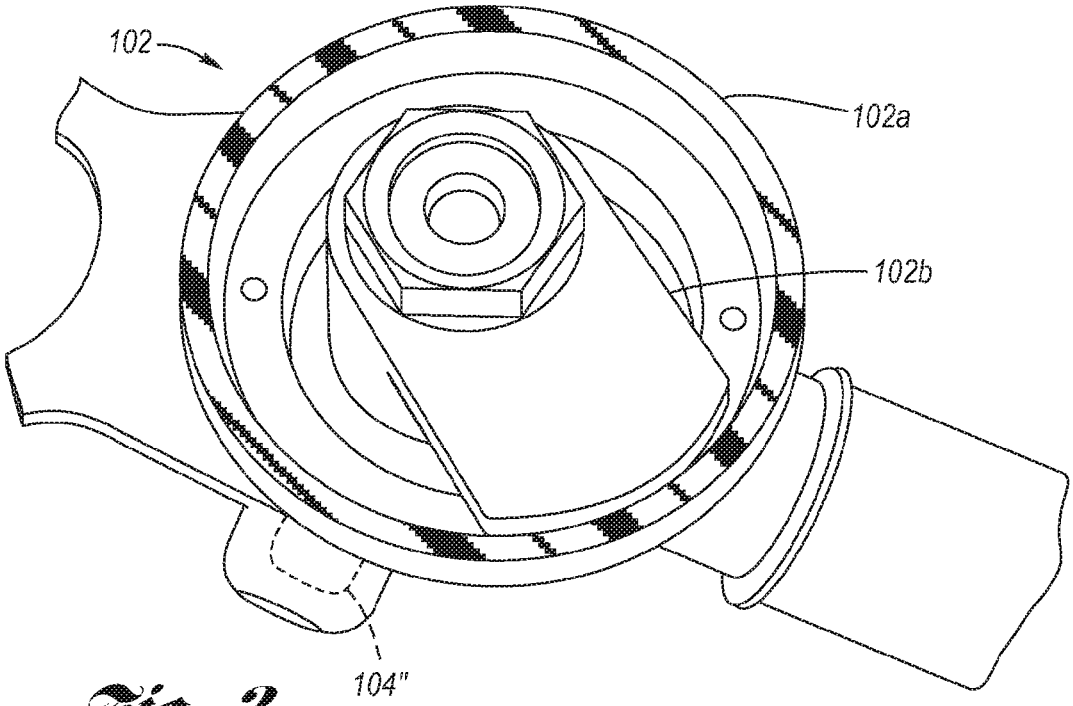
FIG. 3 is a partly sectional view of a polishing tool, showing an internal orbital swing arm and Hall effect sensor for detecting revolutions thereof.

A conventional polishing tool 102, as for example an orbital polishing tool such as for nonlimiting example a model 57126 Dynabuffer™ of Dynabrade, Inc. of Clarence, N.Y. 14031, wherein other polishing tools of other companies may also be used, is modified to include at least one sensor 104. The at least one sensor 104 is, by way of preferred example, a rotational speed sensor 104' affixed to the head 102*a* of the polishing tool 102 which senses the rotational speed of the polishing tool 102. By way of exemplification, the speed sensor 104' is a Hall effect sensor 104", affixed to the head 102*a* of the polishing tool 102 as indicated at FIG. 3, wherein the Hall effect sensor senses the revolutions of the internal orbital swing arm 102*b* of the polishing tool 102. The at least one sensor 104 is connected by a data line 106 to a controller 108.

The intendment is to monitor applied force of the polishing tool upon the painted surface by the operator vis-a-vis a range of acceptable applied forces (applied force KCC), which information is indirectly obtained by knowing in advance the relationship between tool rotational speed and the applied force. It will be understood that the sensor 104 may also be an applied force sensor (i.e., a commercially available pressure sensor) to directly provide applied force data to the controller, as for example located at the handle of the polishing tool or elsewhere.

Figure 1:
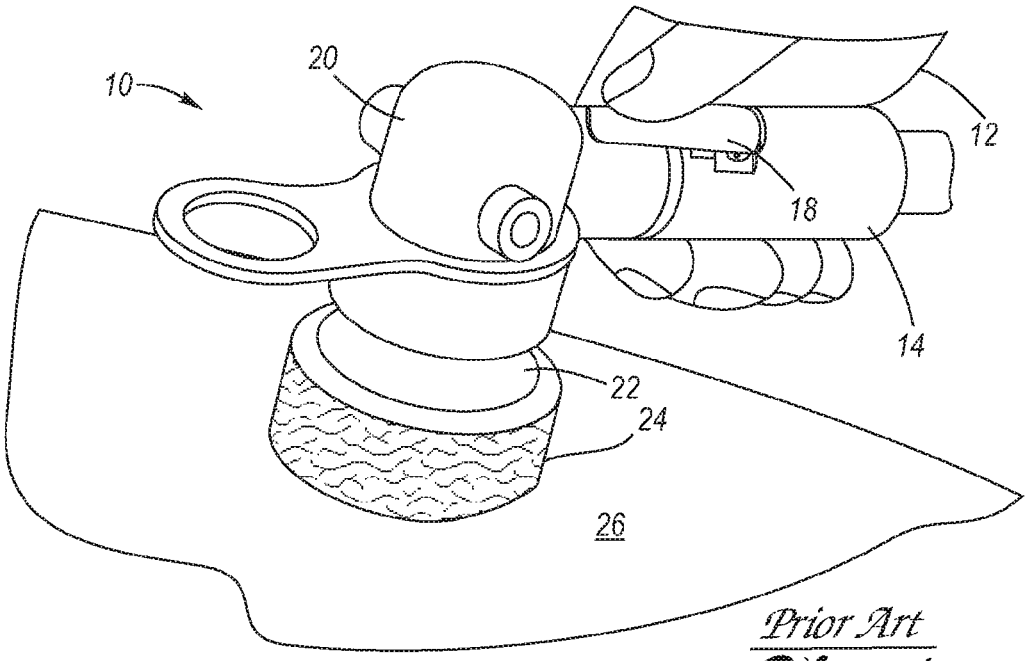
Prior Art Fig. 1
FIG. 1 is a perspective view of a prior art polishing tool being used by an operator to polish a painted surface.
Figure 4:
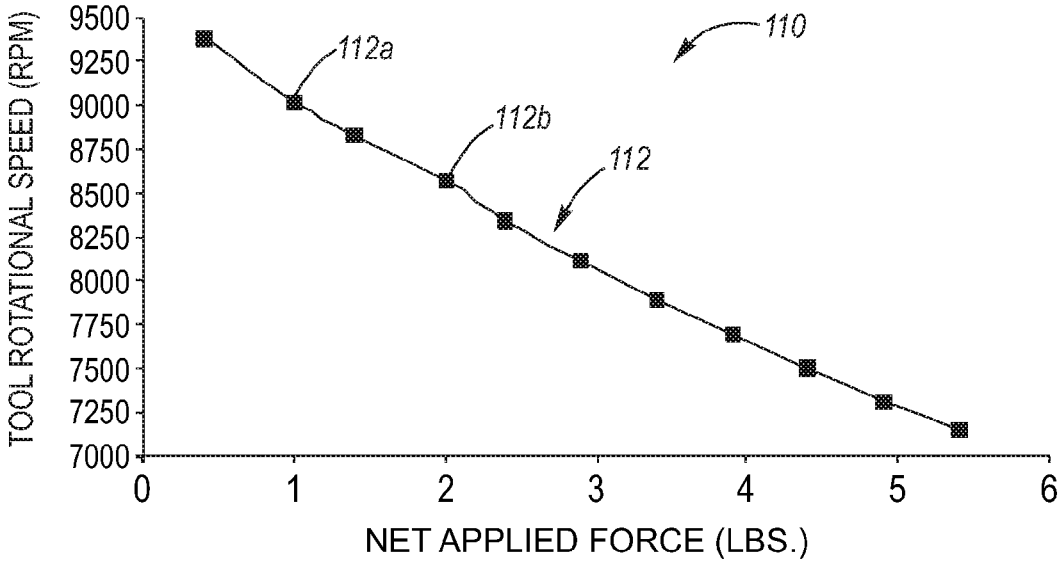
FIG. 4 is a graph of applied force versus polishing tool rotation speed, showing a measured plot of the relationship therebetween for a selected polishing tool.

With regard to using a rotational speed sensor to obtain applied force data, FIG. 4 is a graph 110 of applied force versus polishing tool rotational speed, wherein a plot 112 shows a measured relationship between tool rotational speed and net applied force (net applied force equals the total applied force of the polishing pad 102*c* (for example Finesse-it™ buffing pad 02648 of Minnesota Mining & Manufacturing Co. of St. Paul, Minn. 55144) on the painted surface less the weight of the polishing tool, which is for example about 1.1 pounds, or a little more depending on the weight of the indicator, if present, see below) for a Dynabuffer™ type polishing tool. To perform the test, a 4" by 12" painted surface was placed upon a scale. Prior to each measurement, a dime-size dollop of polish (for example Finesse-it™ polish of Minnesota Mining & Manufacturing Co. of St. Paul, Minn. 55144) was applied to a cleaned area of the painted surface. The polishing tool was then operated normally to polish the painted surface (as for example in a manner depicted at FIG. 1), wherein for each measured rotational speed, the corresponding applied force was read from the scale and recorded. It will be seen that there is a generally linear relationship between tool rotational speed and applied force. This relationship is empirically determined for each selected polishing tool and then programmed into the controller so that the controller is enabled to infer applied force from tool rotational speed data from the speed sensor 104', 104". By way of example as shown by plot 112, a target tool net applied force range is between one pound (see plot point 112*a*) and two pounds (see plot point 112*b*), wherein the corresponding tool rotational speeds are, respectively, 9,012 RPM and 8,568 RPM when a 10,000 RPM pneumatic polishing tool (and polishing pad) as indicated above is operated at 90 PSI.

The controller 108 is any suitable electronic computational device, as for example a microcontroller such as for nonlimiting example a Basic Stamp 2 microcontroller of Parallax, Inc. of Rocklin, Calif. 95765, wherein other microcontollers of other companies may also be used. The controller 108 has a preferably integrated timer device 114, and has various peripheral or integrated devices, including by way of example a data logging device 116, a programming interface 118 and an operator reset device 120. The controller 108 is programmed, for example as detailed hereinbelow with respect to FIG. 9.

Figure 5:
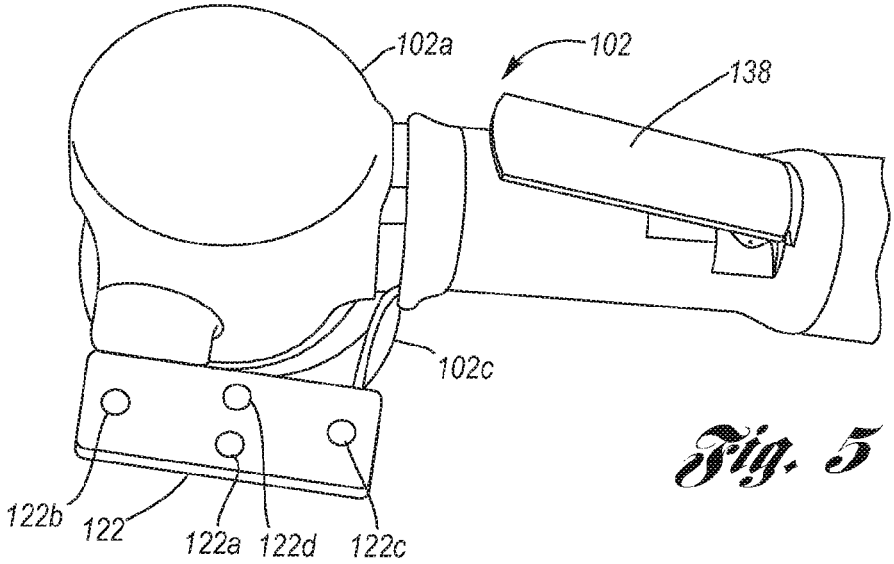
FIG. 5 is a perspective view of a polishing tool modified according to the present invention to incorporate selected apparatus of FIG. 2.

An operator feedback indicator 122 is provided, preferably located at the polishing tool by a modification thereof as shown at FIG. 5 wherein the feedback indicator is affixed to the head 102*a* of the polishing tool 102, or located elsewhere, such as for example (see phantom 122) at the panel 108*a* for housing of the controller 108. By way of exemplification the feedback indicator may inform the operator by means of lights (preferably LEDs) and/or sounds (preferably a siren). Where lights are used, it is preferred to include a normal operation indicator light (preferably green) 122*a* to indicate polishing tool operation is within the at least one KCC, a high indicator light (preferably red, but possibly orange or yellow) 122*b* to indicate polishing tool operation is above the at least one KCC, a low indicator light (preferably red, but possibly orange or yellow) 122*c* to indicate polishing tool operation is below the at least one KCC, and a fault indicator light (preferably red) 122*d* to indicate fault has been detected by the controller 108 pursuant to data from the at least one sensor 104 and the programming (see FIG. 9). Where sound is used, preferably a sound is made when fault has been detected by the controller 108.

As further shown at FIG. 2, the polishing tool is powered by a tool power source 130, as for example electrical power if the polishing tool is electrically powered, or a pressurized air source if the polishing tool is pneumatically operated. A commercially available controlled switch 132 (i.e., an electrical or pneumatic valve wherein the enabled/disabled states thereof being controlled by a signal from the controller, for example Series 8210 solenoid valve of Asco Valve, Inc. of Florham Park, N.J. 07932) is connected through a data line 134 to the controller 108, wherein the controller is able to disable operation of the polishing tool in the event of fault detection. As shown at FIG. 5, the polishing tool 102 may have an actuator arm 138 which when depressed by the operator, closes an internally disposed operator actuation device 140 (i.e., an electrical switch or pneumatic valve) to thereby effect operation of the polishing tool, provided the controller 108 has enabled the controlled switch 132 to deliver power to the polishing tool via power line 142.

Aspects of operation of a preferred form of the present invention can be understood by reference to FIGS. 6A through 8, wherein the selected KCCs are applied force KCC (as inferred from sensed tool rotational speed) and polishing time KCC. It is to be understood, that other KCCs may be selected, such as for example tool movement in relation to the painted surface (tool movement KCC) wherein a conventional motion sensor is interfaced with the controller 108.

Figure 6A:
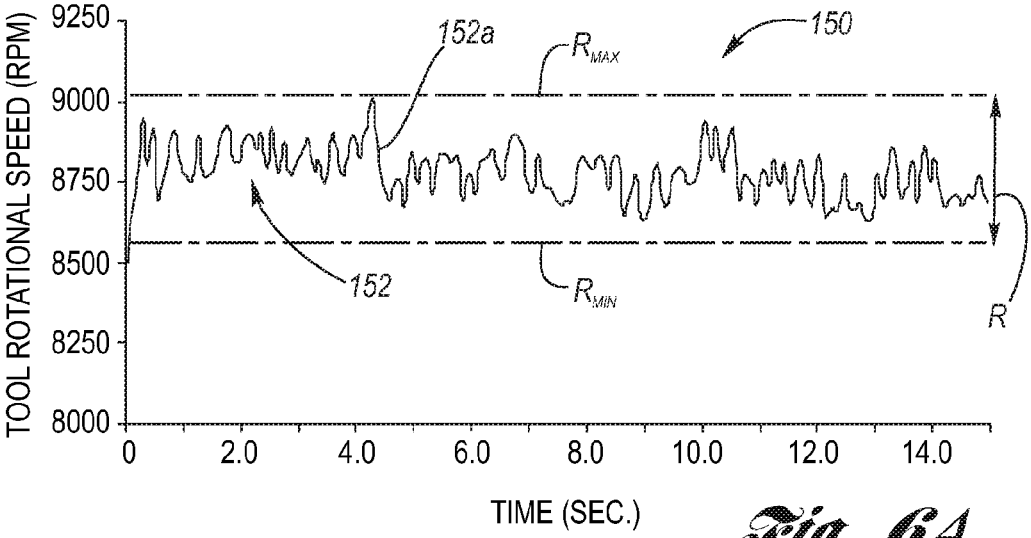
FIG. 6A is a graph of time versus polishing tool rotation speed, showing a measured plot of a successful finesse polishing cycle.
Figure 6B:
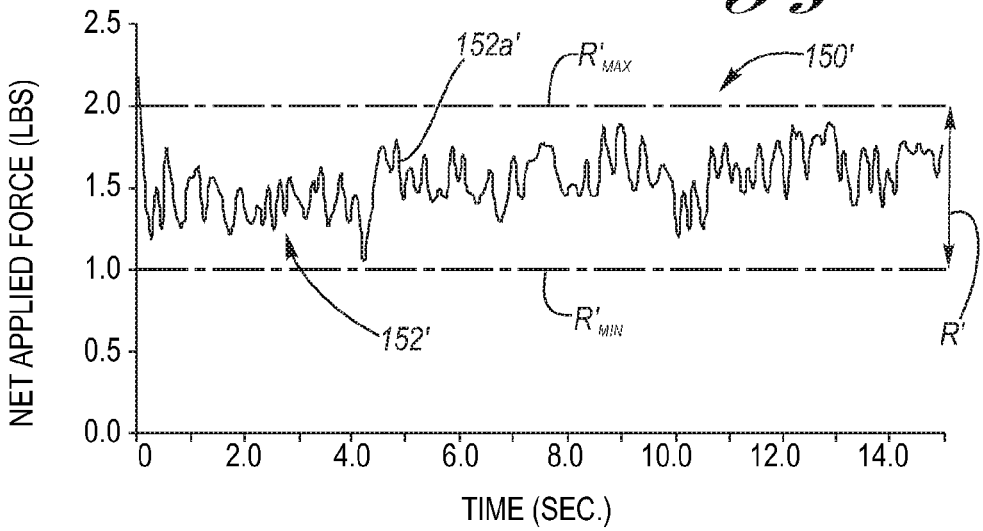
FIG. 6B is a graph of time versus polishing tool net applied force, per the successful finesse polishing cycle of FIG. 6A.

FIGS. 6A and 6B depict a situation in which the operator complies with the predetermined KCCs during operation of the polishing tool. FIG. 6A is a graph of time versus rotational speed of the polishing tool 150 having an acceptable range R of the rotational speed as it relates to the applied force KCC which is inferred from the acceptable range of rotational speed of the polishing tool (as for example per an empirically obtained relation therebetween as shown at FIG. 4), defined by a maximum rotational speed $R_{MAX}$ and minimum rotational speed $R_{MIN}$. The relationship between tool rotational speed and the applied force is explicitly shown by comparison between FIGS. 6A and 6B, where FIG. 6B is a graph of time versus net applied force (total applied force less tool weight) 150' having an acceptable range R' of the net applied force as it relates directly to the applied force KCC, defined by a maximum net applied force $R'_{MAX}$ and minimum net applied force $R'_{MIN}$. In the example of FIGS. 6A and 6B, $R_{MAX}$ is 9,012 RPM which corresponds to $R'_{MIN}$ of one pound, and $R_{MIN}$ is 8,568 RPM which corresponds to $R'_{MAX}$ of two pounds.

Plot 152 is indicative of polishing tool applied force as correlated to rotational speed as a function of time, and plot 152' is indicative of polishing tool net applied force. When power is supplied to the polishing tool by both the operator actuation device 140 and the controlled switch 132 being enabled (or closed), operational rotational speed of the polishing tool is obtained and tool rotational speed is monitored via the sensor 104, 104', 104" and an indicator of the operator compliance with the applied force KCC is output by the controller, which for plot portions 152*a*, 152*a*' is in the form of illumination of the normal operation indicator light 122*a*. It will be seen that plot portion 152*a*, lies between $R_{MAX}$ and $R_{MIN}$, and plot portion 152*a*' lies between $R'_{MAX}$ and $R'_{MIN}$) so that therefore the controller will find no fault because the operator always complies with the applied force KCC by keeping the net applied force between one and two pounds.

Figure 7:
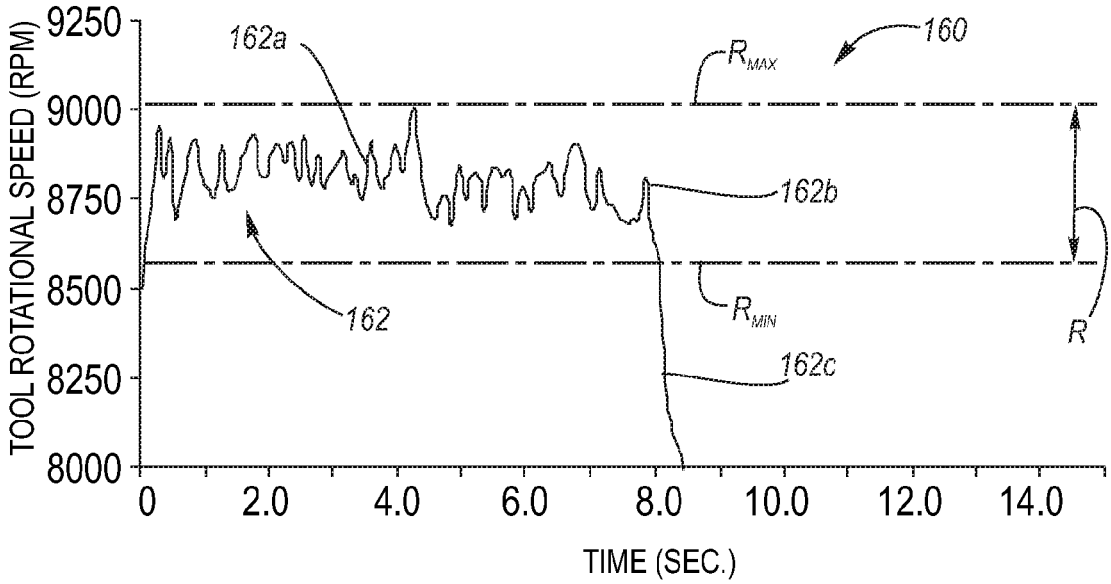
FIG. 7 is a graph of time versus polishing tool rotation speed, showing a measured plot of a finesse polishing cycle interrupted by fault due to operator timing error.

FIG. 7 depicts a situation in which the operator complies with the predetermined KCCs during a first portion of operation of the polishing tool, but then prematurely releases the operator actuation device 140. As in FIG. 6A, a graph of time versus rotational speed of the polishing tool 160 shows the acceptable range R of the applied force KCC inferred from the acceptable range of rotational speed of the polishing tool (as for example per an empirically obtained relation therebetween as shown at FIG. 4), defined by a maximum rotational speed $R_{MAX}$ of 9,012 RPM corresponding to a minimum net applied force of the pad of the polishing tool against the painted surface of one pound, and minimum rotational speed $R_{MIN}$ of 8,568 RPM corresponding to a maximum net applied force of the pad of the polishing tool against the painted surface of two pounds. Plot 162 is indicative of polishing tool applied force as correlated to rotational speed as a function of time. Tool rotational speed is monitored via the sensor 104, 104', 104" and an indicator of the operator compliance with the applied force KCC is output by the controller, which for plot portion 162*a* is in the form of illumination of the normal operation indicator light 122*a*, in that the applied force KCC is being met. However, at point 162*b* the operator actuation device is prematurely released by the operator, as indicated by plot portion 162*c*. In this situation, the controller 108 determines a fault because the polishing time KCC has not been fulfilled, turns off the normal operation indicator light 122*a*, illuminates the fault indicator light 122*d*, and disables the controlled switch 132, preventing polishing tool operation until the system fault is remedied by manually pressing the operator reset device 120.

With regard further to the polishing time KCC, the operator is expected to operate the polishing tool until the controller has determined that the polishing time KCC duration has been fulfilled, whereupon the controller momentarily disables the controlled switch to inform the operator of the polishing time KCC fulfillment and to immediately cease polishing. In this manner the operator learns the polishing time KCC duration, which may be, for example between 8 and 16 seconds, 15 seconds being shown by way of exemplification in FIGS. 6A through 8.

Figure 8:
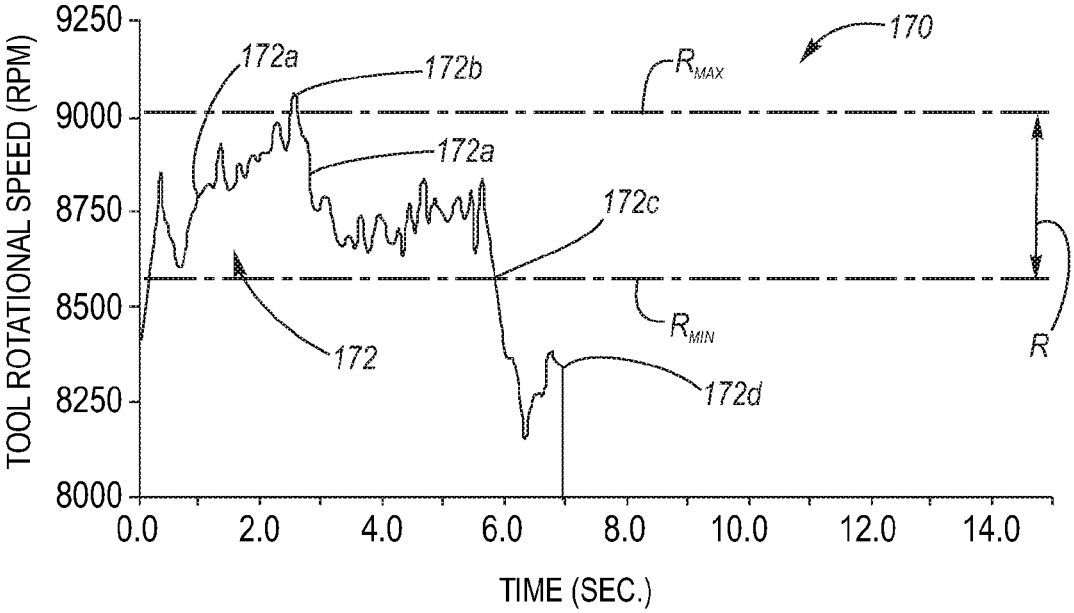
FIG. 8 is a graph of time versus polishing tool rotation speed, showing a measured plot of a finesse polishing cycle interrupted by a fault due to operator applied force error.

FIG. 8 depicts a situation in which the operator complies with the predetermined KCCs during a first portion of operation of the polishing tool, but then fails to comply during a second portion of the operation. As in FIG. 6A, a graph of time versus rotational speed of the polishing tool 170 shows the acceptable range R of the applied force KCC inferred from the acceptable range of rotational speed of the polishing tool (as for example per an empirically obtained relation therebetween as shown at FIG. 4), defined by a maximum rotational speed $R_{MAX}$ of 9,012 RPM corresponding to a minimum net applied force of the pad of the polishing tool against the painted surface of one pound, and minimum rotational speed $R_{MIN}$ of 8,568 RPM corresponding to a maximum net applied force of the pad of the polishing tool against the painted surface of two pounds. Plot 172 is indicative of polishing tool applied force as correlated to rotational speed as a function of time. When power is supplied to the polishing tool by both the operator actuation device 140 and the controlled switch 132 being enabled (or closed), the tool rotation speed increases and tool rotational speed is monitored via the sensor 104, 104', 104" and an indicator of the operator compliance with the applied force KCC is output by the controller, which for plot portion 172*a* is in the form of illumination of the normal operation indicator light 122*a*. It will be seen that plot portion 172*c* lies between $R_{MAX}$ and $R_{MIN}$, even if momentarily above $R_{MAX}$ at plot portion 172*b*, so that therefore the controller will find no fault due to applied force KCC. However, the operator begins noncompliance to the applied force KCC at point 172*c* when he/she presses too hard, corresponding to the rotational speed falling below $R_{MIN}$. The controller 108 detects this event and times its duration, as for example for about 1.5 seconds of noncompliance time by the operator during plot portion 172*e*, where during the controller turns off the normal operation indicator light 122*a*, illuminates the high indicator light 122*b* (note that the high indicator light is illuminated because the applied force is too high and is the KCC of concern is applied force, not tool rotational speed). At the end of a permitted noncompliance time (as for example 1.5 seconds), the controller 108 finds a system fault at point 172*d*, whereupon the controller turns off the high operation indicator light 122*b*, illuminates the fault indicator light 122*d*, and disables the controlled switch so that power to the polishing tool is terminated. In this situation, the controller 108 prevents polishing tool operation until the system fault is remedied by manually pressing the operator reset 120.

Figure 9:
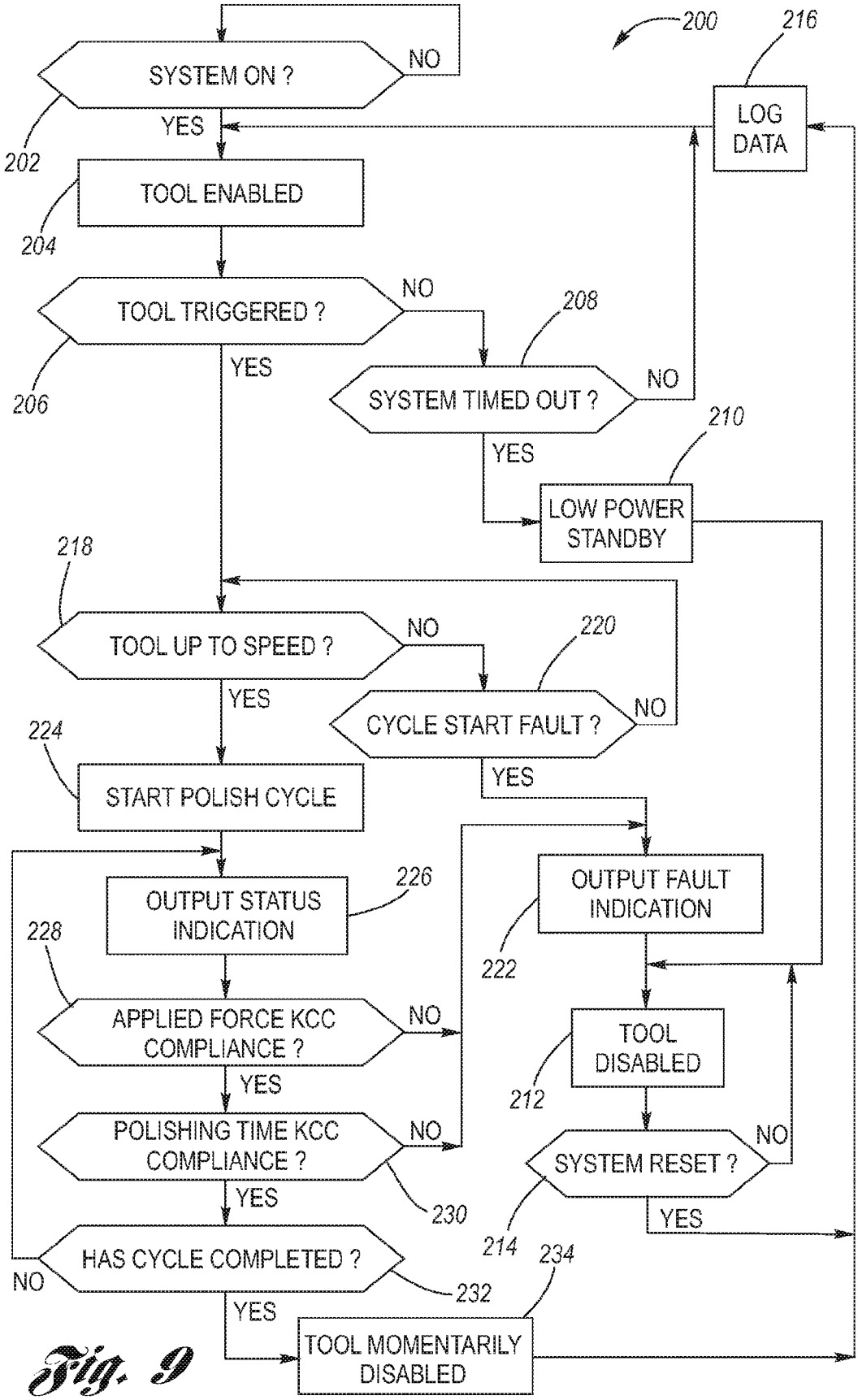
FIG. 9 is a flow chart for an exemplar programming of the controller of FIG. 2.

Turning attention now to FIG. 9, an example of an algorithm 200 for programming the controller 108 will be detailed.

At Decision Block 202, inquiry is made whether the system is in operation, waiting until the answer to the inquiry is yes, whereupon the program advances to Block 204, whereat the controlled switch 132 is enabled. At Decision Block 206 inquiry is made whether the operator actuation switch 140 is enabled (i.e., whether the polishing tool is triggered). If the answer to the inquiry is no, then the program advances to Decision Block 208, whereat inquiry is made whether a predetermined time duration has passed without tool triggering. If the answer to the inquiry is no then the program loops back to Block 204; however, if the answer to the inquiry is yes, then the program advances to Block 210 whereat power is put into a conservation mode and the polishing tool disabled at Block 212 due to disablement of the controlled switch 132. At Decision Bock 214, inquiry is made whether the operator reset device 120 has been manually reset (i.e., pressed), and if the answer to the inquiry is yes, then the event is stored in a log at Block 216 and the program returns to Block 204.

Considering again Decision Block 206, if the answer to the inquiry is yes, then the program advances to Decision Block 218, whereat inquiry is made, per data from the speed sensor, whether the operational tool rotational speed of the polishing tool has been achieved. If the answer to the inquiry is no, then at Decision Block 220 inquiry is further made whether a tool start fault has occurred, wherein if the answer to the inquiry is yes, then the program advances to Block 222, whereat the fault indicator light is illuminated and then advances to Block 212 and thereafter as described hereinabove.

Considering again Decision Block 218, if the answer to the inquiry thereat is yes, then at Block 224 the polishing cycle begins to be timed according to the polishing time KCC. At Block 226 the operational condition of the polishing tool is indicated at the feedback indicator 122, vis-à-vis the applied force and polishing time KCCs. The speed sensor data is converted into applied force data per the empirically determined relationship therebetween, and as long as the applied force is within the acceptable range of the applied force KCC, normal operation indicator light is illuminated at Block 226, otherwise either the high or the low indicator light is illuminated at Block 226.

The program then advances to Decision Block 228, whereat inquiry is made whether the operator is complying with the applied force KCC, per data from a speed sensor per correlation with the empirically determined rotational speed relationship. If the answer to the inquiry is no, that is, if the operator has operated the polishing tool outside the predetermined range of the applied force KCC for a predetermined noncompliance time, then the program advances to Block 222, whereat only the fault indicator light is illuminated and thereupon further advances to Block 212 and further as described hereinabove. However, if the inquiry at Decision Block 228 is yes, then the program advances to Decision Block 230.

At Decision Block 230, inquiry is made whether the operator is complying with the polishing time KCC. If the answer to the inquiry is no, as for example if the operator disabled the operator actuation device 140 prematurely (see FIG. 7), then the program advances to Decision Block 222 and further as described hereinabove. However, if the answer to the inquiry is yes, then the program advances to Decision Block 232, whereat inquiry is made whether the polish cycle has completed on time, as for example completed by a predetermined elapsed time since Block 224, for example 15 seconds, wherein if the answer to the inquiry is no, then the program returns to Decision Block 226; however, if the answer to the inquiry is yes, then the program advances to Block 234, whereat a momentary disablement of the tool via the controlled switch 132 occurs which is intended to inform an operator who is still polishing that the polishing time KCC has been fulfilled, and that polishing must cease. The program then advances to Block 216 and further as described hereinabove.

Pursuant to the above detailed description with respect to a hand held polishing tool, it is to be understood that any power hand tool may be quantitatively process controlled by identifying operational characteristics of the tool (as for example key control characteristics), sensing at least of the operational characteristics, and providing operational control of the tool and operator feedback of operator compliance with a predetermined range of the operational characteristics per a controller.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. A system for providing quantitative process control of a power hand tool, comprising:

a hand tool having predetermined operational characteristics when operating;

a controller;

at least one sensor sensing at least one operational characteristic of the predetermined operational characteristics which is subject to operator control during operation of the tool, said at least one sensor being connected to said controller to thereby provide said controller with data related to the sensed at least one operational characteristic;

a controlled switch connected with said tool and said controller such that said controller selectively enables and disables said controlled switch, wherein said controlled switch enables power to said tool when said controlled switch is enabled, and wherein said controlled switch disables power to said tool when said controlled switch is disabled; and a feedback indicator connected with said controller, wherein said controller compares the sensed at least one operational characteristic to at least one respectively corresponding predetermined operational characteristic of the predetermined operational characteristics and thereupon registers at said feedback indicator selected information regarding the comparison comprising at least one of a visual indicator and an audible indicator, said at least one of a visual indicator and an audible indicator being configured to inform an operator of the tool of the operator's compliance with the at least one respectively corresponding predetermined operational characteristic of the predetermined operational characteristic;

wherein said controller selectively enables and disables said controlled switch responsive to said at least one sensor sensing the at least one operational characteristic;

wherein said at least one operational characteristic comprises applied force of said tool with respect to a surface;

wherein said controller enables and disables said controlled switch responsive to said controller determining either one of the applied force being below a redetermined minimum a lied force and the applied force being above a predetermined maximum applied force; and wherein:

said controller provides a first said at least one of a visual indicator and an audible indicator at said feedback indicator responsive to the applied force being between the maximum and minimum applied forces;

said controller provides a second said at least one of a visual indicator and an audible indicator at said feedback indicator responsive to the applied force being above the maximum applied force;

said controller provides a third said at least one of a visual indicator and an audible indicator at said feedback indicator responsive to the applied force being below the minimum applied force; and said controller provides a fourth said at least one of a visual indicator and an audible indicator at said feedback indicator responsive to said controller disabling said controlled switch.

2. The system of claim 1, wherein said tool comprises a polishing tool; and wherein the at least one operational characteristic comprises at least one key control characteristic of the operation of the tool.

3. The system of claim 1, wherein said at least one sensor senses rotational speed of said tool; wherein said controller converts the rotational speed into the applied force according to a predetermined relationship therebetween.

4. The system of claim 1, further comprising an operator reset device connected to said controller, wherein when said controller disables said controlled switch, a manual reset of said operator reset device is required before said controller will thereafter enable said controlled switch.

5. The system of claim 2, wherein said at least one operational characteristic comprises polishing time; wherein said controller further selectively enables and disables said controlled switch responsive to said polishing tool being operated in compliance with said polishing time.

6. The system of claim 5, wherein said at least one sensor senses rotational speed of said tool; wherein said controller converts the rotational speed into the applied force according to a predetermined relationship therebetween.

7. The system of claim 6, further comprising an operator reset device connected to said controller, wherein when said controller disables said controlled switch, a manual reset of said operator reset device is required before said controller will thereafter enable said controlled switch.

* * * * *